United States Patent [19]

Kruger

[11] 4,419,851

[45] Dec. 13, 1983

[54] STAIR STRUCTURE FOR STORAGE BINS

[75] Inventor: Joseph A. Kruger, Warsaw, Ind.

[73] Assignee: Brock Manufacturing, Inc., Milford, Ind.

[21] Appl. No.: 286,163

[22] Filed: Jul. 23, 1981

[51] Int. Cl.[3] ..... E04F 11/00

[52] U.S. Cl. ..... 52/184; 52/187

[58] Field of Search ..... 52/184, 187, 183, 191, 52/182; 182/93, 83

[56] References Cited

U.S. PATENT DOCUMENTS

| | | | |
|---|---|---|---|
| 367,974 | 8/1887 | Hanson | 52/184 |
| 1,547,254 | 7/1925 | McClure | 52/187 |
| 3,473,275 | 10/1969 | Lappin, Jr. | 52/187 |
| 3,474,882 | 10/1969 | Ernst | 182/106 |
| 4,143,740 | 3/1979 | Matthews | 182/93 |
| 4,355,700 | 10/1982 | Matthews et al. | 52/187 X |

*Primary Examiner*—Philip C. Kannan

*Attorney, Agent, or Firm*—Trexler, Bushnell & Wolters, Ltd.

[57] ABSTRACT

There s disclosed a stariway system having a single stringer assembly and tread members which may be attached to a receiving structure by means of pre-existing through bores therein. The system may be adapted to walls having a horizontal curvature as the stringer assembly is composed of individual stringer sections which may be adjusted to allow each of the treads to be splayed along a radius of the curvature to provide a stairway having a constant tread width along the line of travel.

10 Claims, 9 Drawing Figures

22
23
30
28
30
132
14a
14b
24
26
21
134
138
136
106
16c
20c
36
38
35
18
20
34
34
16b
16a
20a
36a
34
106
12
16
20b
34
20
14
14c
36
32
10
130
16d
34

3
40
96
41
22
100
20
20
98
4
34
48
20
42
16a
3
20b
102
50
20a
46
4
52
20
20

35
22
24b
24a
24
16d
16a
16b
16c
86
16b
34a
92

90
78
16a
5
82
105
16a
76
78
100
10A
5
76
80
10A
80
20a
20b
35
20a
102
36a 94
94
88
34b
24
54
60
62
56
30
58
58
60
28
24
54
30
63

64
66
65
68
70
74
22
60
30
24a
24b
72
28
72
38
58
20c
30
38
61
61c
61a
61b
110a
14a
112
12
16c
114
116
14b 128
14a
126
118
120
78c
16c
20d
20c
110a
82c
107b
14b
107b
122
124
108a
84c
80c
104c 107
110b
14
108
110

STAIR STRUCTURE FOR STORAGE BINS

BACKGROUND OF THE INVENTION

The invention relates generally to wall mounted stairway systems or ladders and more particularly to an external wall mounted stairway system for a building which is constructed of adjacent wall sections joined by a number of regularly-spaced through bores and fasteners, and for a building having curved horizontal walls.

It has been a desideratum in the art to provide a stairway system for farm and other storage buildings which is inexpensive, simple to install and easily adaptable to a wide range of building shapes and sizes without the need for modification of the receiving structure.

Residential or internal stairways have long been constructed using a series of treads supported by two or more stringers or carriages which extend from a first level to the next floor or landing. External stairways on storage buildings and the like have long been constructed in essentially the same manner, and this manner of construction has lead to problems in efficiency, safety and strength.

Storage buildings are generally prefabricated in the form of wall sections, often corrugated for increased strength. Each wall section overlaps and is secured to the adjacent sections by fasteners which are disposed in regularly-spaced, preformed bolt holes. These overlapping portions or seams of the wall sections may contribute substantially to the overall strength of the wall. Due to the fact that not all storage structures require external stairways, dependent on the placement and use, it is advantageous to provide a stairway system which may be owner-installed on various storage structures when the need for such a stairway arises.

However, storage structures come in a wide variety of sizes and shapes, with accompanying variations in wall section sizes and bolt hole spaces. Standard stairway construction, which requires an internal stringer adjacent and secured to the wall, is often inappropriate in that the bolt holes for attaching the stringer cannot adapt to the overlapping seams and bolt hole spacing in the many sizes of storage structures. The overlapping seams, being of double thickness, are the strongest point in the structure for the attachment of external stairs, it is often desirable to use the pre-existing bolt holes therein as attachment points.

In addition, the structure may be rectangular in cross section, having planar walls; or circular in cross section, requiring walls and wall sections having a horizontal curvature. These non-linear walls present additional problems due to their horizontal curvature. An external stairway on such a structure may be comprised of a series of straight stair runs, or constructed as winder or geometric stairs with the center of convergence located substantially at the center of the radius of the wall on which they are installed.

Geometric stairs have heretofore been unacceptable except in custom installations wherein the tread members are individually welded to the non-linear wall. This method is not only expensive, but prohibits the removal and transfer of the stairway to a second structure. In addition, there must also be provided an external or second stringer to support the external ends of the treads, and this stringer must be of a curvature substantially equal to that of the wall itself. This factor requires custom stringer construction for each building. The chief problem in the design of winder stairs adaptable to non-linear walls having various radii of curvature is that a constant tread width must be maintained along the user's line of travel to avoid the missteps or stumbling which may otherwise occur, due to the common expectation that the rise and run of stairways will be constant. A person tends to measure, subconsciously, the first few treads and can easily trip on subsequent steps involving a different tread width.

Accordingly, it is an object of this invention to provide a stairway system which may be easily installed on a structure having overlapping wall sections.

Another object is to provide a wall mounted stairway having a single stringer or carriage assembly.

A further object is to provide a stairway for a wall having a horizontal curvature, the stairway having treads arrayed on radii of the curvature to provide a constant tread width along the stairway.

A still further object is to provide a stairway for a wall having a horizontal curvature, the stairway having a single stringer assembly comprised of adjustable stringer sections to enable installation on non-linear walls of various curvatures and sizes.

SUMMARY OF THE INVENTION

The foregoing and other objects and advantages may be achieved with the stairway system of the present invention, which includes an array of vertical bracket means attached to a wall through the overlapping seams thereof or by the use of the pre-existing regularly spaced bolt holes therein. The tread members are, in turn, secured to the brackets, and supported at their external ends by a single stringer or carriage. This external stringer may be comprised of prefabricated stringer sections to facilitate variations in the length of the stairway as the need may arise. The stringer sections may also be adjustable horizontally, permitting variation in the distance between the individual treads to allow installation on walls of different curvature while maintaining a constant tread width along the line of travel.

DETAILED DESCRIPTION OF THE ILLUSTRATED EMBODIMENT

Figure 1:
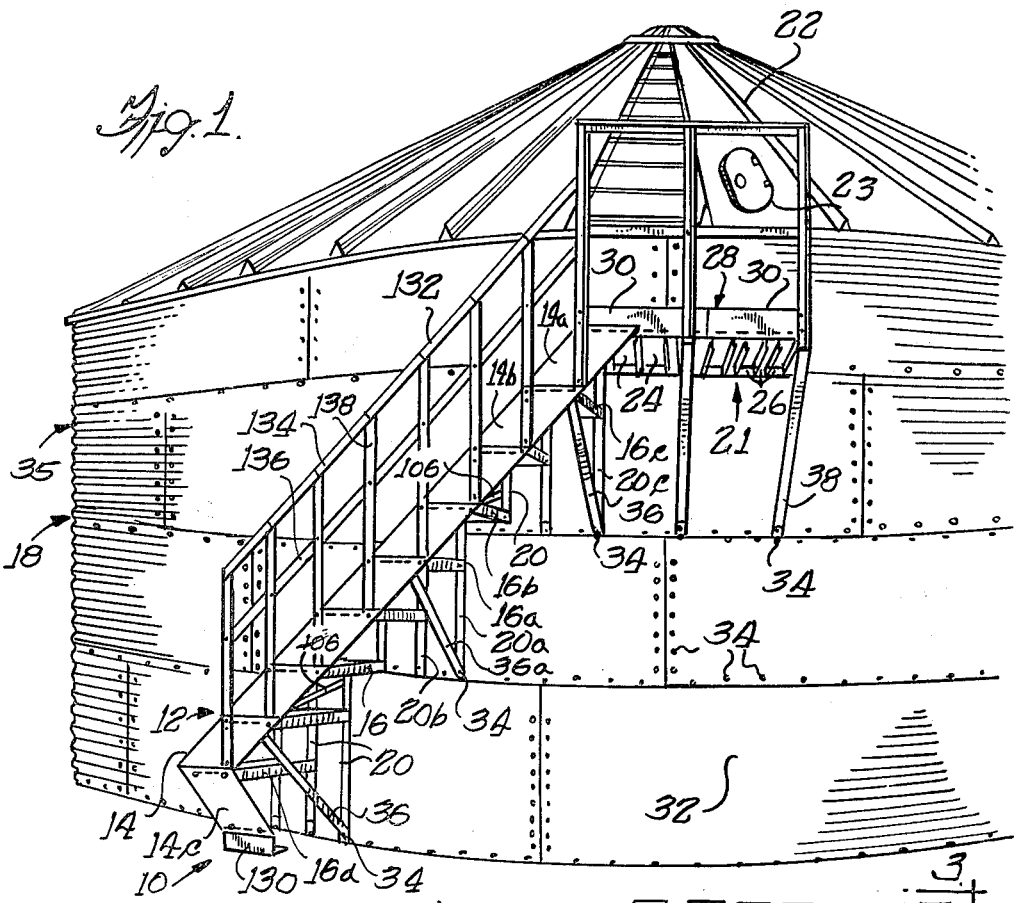
FIG. 1 is a perspective view of the stairway mounted on a storage structure.

The drawings illustrate a preferred form of the stairway system of the present invention, the system being designated generally by the numeral 10. In FIG. 1, the stairway system 10 is shown to include an external stringer assembly 12 composed of a plurality of adjacent stringer sections 14 including top sections 14*a*, 14*b* and a bottom section 14*c*, as hereinafter described. The stairway 10 also includes an appropriate number of tread members 16, including intermediate tread members 16*a*, 16*b* and top and bottom tread members 16*c*, 16*d* respectively, disposed between the stringer assembly 12 and a storage structure 18 by means of an array of brackets 20.

Also included in the stairway system 10 is a platform 21, to facilitate access to a ladder 22 and manhole 23 atop the storage structure 18. The platform 21 may be composed of a desired number of platform members 24, platform brackets 26 and a platform stringer assembly 28 include a plurality of platform stringer section. The specific aspects of the above-mentioned construction will be more fully described hereinafter.

The storage structure 18 is seen to comprise a series of wall sections 32, each of which overlies an adjacent wall section and is secured thereto by a plurality of regularly-spaced wall fastener assemblies 34 to form a wall 35 having a horizontal curvature. The fasteners 34 are disposed in preformed regularly-spaced bolt holes, not specifically shown in FIG. 1, in the wall sections 32.

Support means are provided for the stairway system 10, and include a desired number of tread braces 36 and platform braces 38. It is to be noted that the braces 36 and 38, as well as the brackets 20, are shown to be secured to the storage structure 18 by means of appropriate regularly-spaced wall bolts 34.

Figure 2:
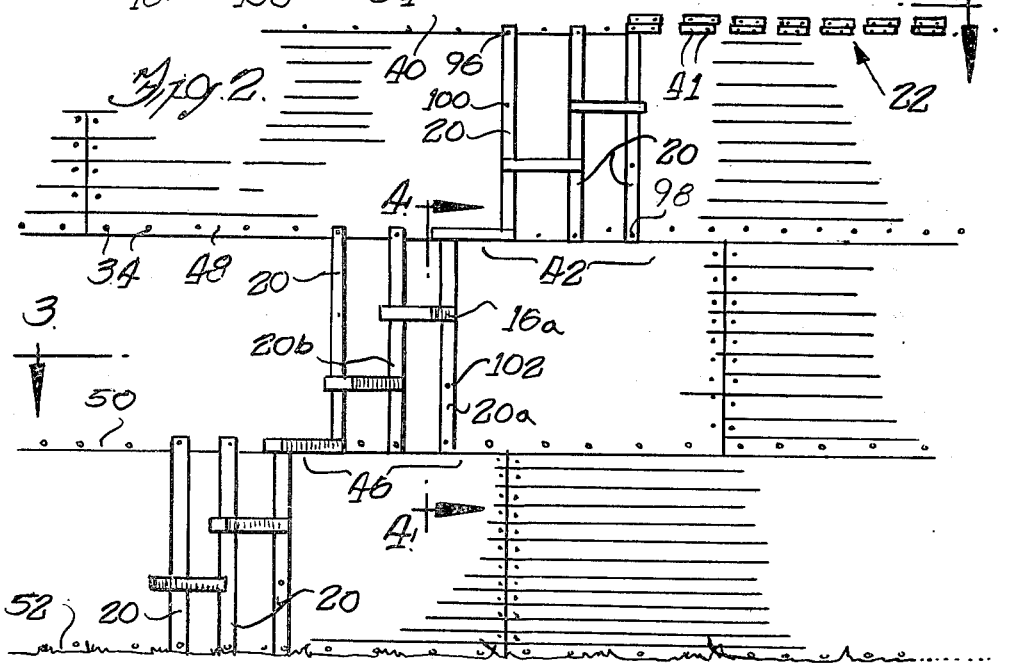
FIG. 2 is a diagrammatic side view of the bracket means, tread members and platform members according to the present invention.

The construction of the stairway system 10 and its installation on the storage structure 18 will now be described with reference to FIGS. 2–9, inclusive. As shown in FIG. 2, the platform members 24 are first installed on an appropriate overlapping seam 40 by a plurality of bolts 41 disposed in bolt holes, not specifically shown, therethrough. Thereafter, the brackets 20 are installed, here in sets of three including an upper set 42, a lower set 44 and an intermediate set 46. Each of the brackets 20 in the upper set 42 are attached at an upper end to the overlapping seam 40 and at a lower end to an overlapping seam 48. In turn, each of the brackets 20 in the intermediate set 46 are attached at an upper end to the overlapping seam 48 and at a lower end to an overlapping seam 50. Likewise, each of the brackets 20 of the lower bracket set 44 are attached at an upper end to the overlapping seam 50 and at a lower end to a foundation seam 42. Thus, the attachment of each bracket 20 to the structure 18 is made at one of the overlapping seams 40, 48, 50 or 52 and may advantageously be made by a plurality of the existing wall bolts 34 or through the formation of additional bolt holes in said seams, not shown.

Figures 3, 4, 5, 6:
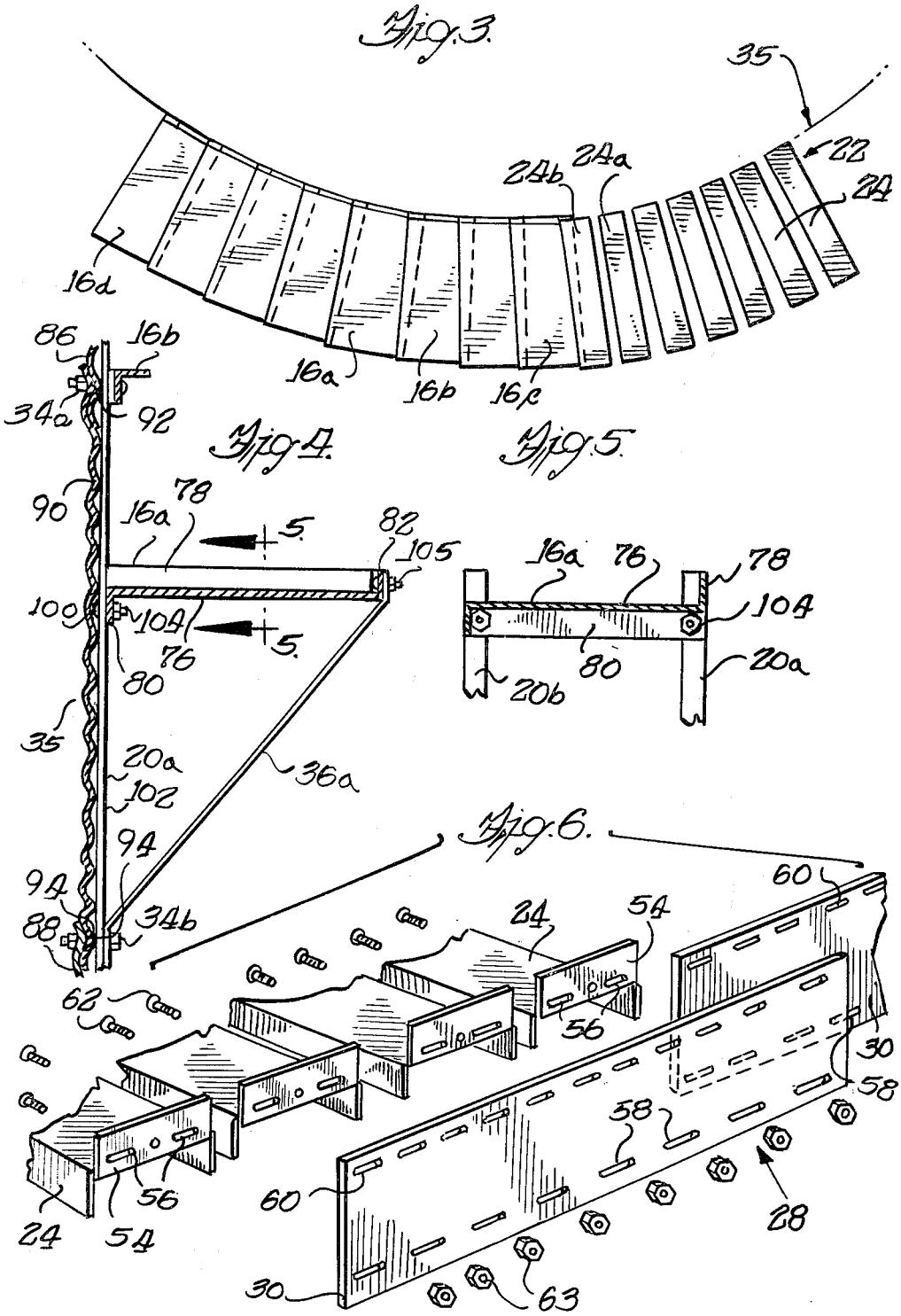
FIG. 3 is a top view of the stairway structure taken along the lines 3—3 of FIG. 2.
FIG. 4 is a diagrammatic view, partially in section, of the tread member, bracket means and wall section taken along the lines 4—4 of FIG. 2.
FIG. 5 is a diagrammatic side view, partially in section, taken along the lines 5—5 of FIG. 4.
FIG. 6 is an exploded perspective view of the platform members and platform stringer assembly.

As is shown in FIG. 3 the platform members 24, when attached to the horizontally curved wall 35 as hereinbefore described, diverge outwardly with each of the platform members 24 extending from the wall 35 substantially along a radius of the wall curvature. As storage structures of various sizes will result in a variation of the divergence and distance between the outer ends of the adjacent platform members 24, the platform 21 is provided with the novel platform stringer assembly 28.

As is shown in detail in FIG. 6, each of the platform tread members 24 is provided with an outer flange 54 which contains a plurality of horizontal slots 56. The platform stringer assembly 28 is likewise comprised of a plurality of platform stringer sections 30, each provided with a lower and upper row of horizontal slots 58 and 60, respectively. When assembled, each of the slots 56 in the individual tread members 24 will cooperate with one of the lower slots 58 on the platform stringer section 30, with each of the platform members 24 being secured to one or more of the stringer sections 30 by means of the fastener assemblies 61, indicated by bolt members 62 and nut members 63. The upper edges of the platform stringer sections 30 are secured by additional fasteners, not shown, passing through one or more of the upper slots 60.

As is seen, the horizontal slots 56, 58 and 60 allow the construction of an external stringer assembly 28 of varied length which adjustably supports the platform members 24, and is thus adaptable to a wide variation in differences in the curvature of the wall 35.

Returning now to FIG. 7, the platform 21 is further provided with a platform handrail assembly 64 comprising a handrail 65, a first and second balluster 66 and 68, respectively, and an auxiliary rail 70. Each of the ballusters 66 and 68 are secured to the platform stringer assembly 28 by one of the fastener assemblies 61, and by a fastener assembly 72 disposed in one of the upper slots 60 of the platform stringer sections 30. The platform 21 also includes a third balluster 74 which is secured to the platform stringer assembly 28 in a similar manner, and to the top of the stringer assembly 12 in a manner more fully hereinafter described.

External support for the platform 21 is provided by the platform braces 38 which are each secured to the platform stringer assembly 28 by one of the bolt and nut members 62, 63.

The upper handrail 65 and the auxiliary rail 70 are secured to the ballusters 66, 68 and 74 through the use of fastener assemblies as known in the art.

Figures 7, 8, 9:
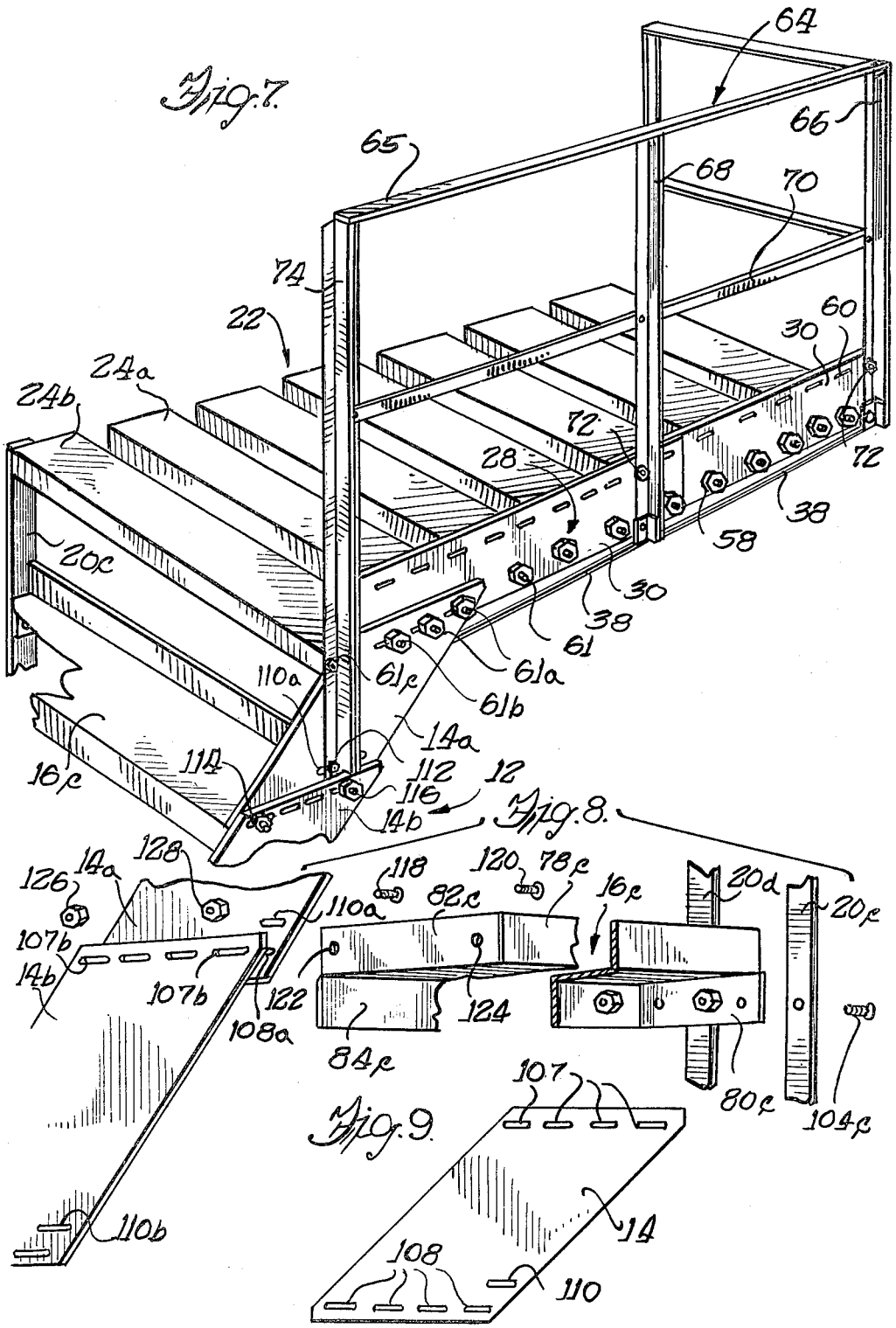
FIG. 7 is a partial perspective view of the platform structure.
FIG. 8 is an exploded perspective view, partially in section, of a tread member, bracket means and stringer sections according to the present invention.
FIG. 9 is a side view of the stringer section of the invention.

Turning now to FIG. 4, each of the tread members 16 is seen to comprise a tread portion 76, a riser flange 78, an inner downturned flange 80 and an upper flange 82. As is seen in FIG. 8, the tread member 16*c* further includes a downturned front flange 84*c*.

As has been described with reference to FIGS. 1 and 2, the brackets 20 are secured to the wall of the storage structure by the overlapping seams therein. Specifically, as shown in FIG. 4, the wall 35 is seen to have an upper wall section 86, a lower wall section 88 and an intermediate wall section 90. The upper wall section 86 overlies the intermediate section 90 to form an overlapping seam 92 and, likewise, the intermediate section 90 overlies the lower section 88 to form an overlapping seam 94. As hereinbefore described, the sections 86, 88 and 90 are joined at the overlapping seams 92 and 94 by the wall bolts 34. Specifically, in FIG. 4, an upper end of the bracket 20*a* is secured to the wall 35 at the seam 92 by the fastener assembly 34*a*, and at the seam 34 by the fastener assembly 34*b*. As previously mentioned, ease of installation is facilitated by the use of the preformed bolt holes, not shown, used to construct the wall 35.

As is shown in FIG. 2, the brackets 20 are installed in sets of three between the seams 40 and 48, 48 and 50, and 50 and 52, progressing downward from the platform 22. Each of the brackets 20 is seen to include an upper bore 96 and a lower bore 98, used to secure the bracket 20 to the wall 35 as hereinbefore described, and upper and lower intermediate bores 100, 102 respectively.

As is shown in FIG. 4, the tread member 16a is secured to the bracket 20a by a fastener assembly 104 which passes through the upper intermediate bore 100 of the bracket 20a and through a bore, not specifically shown, in the inner flange 80 of the tread member 16a.

External support for the tread members 16 are provided by the tread braces 36 and specifically, as shown in FIG. 4, the tread member 16a is supported by a tread brace 36a which is secured at a lower end to the fastener 34b and at an upper end by a fastener 105 disposed through the brace 36a and the outer flange 82 of the tread member 16a. In FIG. 5, the tread member 16a is seen to be further secured by attachment to an additional bracket 20b in a similar manner.

Returning to FIGS. 1 and 2, each of the tread members 16 is similarly secured to two of the brackets 20 in a fashion which provides an orderly succession of stairs from the platform 21. The use of the regularly-spaced bore holes 34, or other regular spacing, to provide a standard horizontal distance between the individual brackets, and the regular spacing of the preformed bores 96, 98, 100 and 102 in the brackets 20 ensure that the rise and run of each individual tread member 16 is the same. Thus, the relationship between the rise and the run of the stairway system 10, a most vital factor in stair design, may be maintained within acceptable limits.

Additional support members may be provided for the stairway system 10, dependent upon the construction of the storage structure 18. For example, in storage bins lacking stiffeners or having internal stiffening members one or more tie straps 106 may be used as is suggested in FIG. 1. In storage bins having outside stiffeners, however, the stairway system 10 has been found to have sufficient support without the use of the tie straps 106.

Turning now to FIGS. 7–9, the construction of the stringer assembly 12 will be described.

Each of the stringer sections 14 is seen to comprise a sheet of appropriate material substantially in the shape of a parallelogram, and including an upper row of horizontal slots 107, a lower row of horizontal slots 108 and an intermediate horizontal slot 110. As shown in FIG. 7, the top stringer section 14a is installed on the platform stringer assembly 28, secured to the platform member 24a by the fastener assemblies 61a, and secured to the platform member 24b by a fastener assembly 61b in a manner similar to that hereinbefore described. In addition, the stringer section 14a is secured to the platform member 24b and to the third balluster 74 by the fastener assembly 61c. The lower end of the balluster 74 is further secured to the stringer section 14a by a fastener assembly 112 disposed through the slot 110a therein. Subsequently, the tread member 16c, heretofore secured to the braces 20c and 20d in a manner hereinbefore described with respect to the tread member 16a, is secured to the lower edge of the stringer section 14a by the fastener assemblies 114 and 116. The fastener assemblies 114 and 116 are comprised, respectively, of bolt members 118 and 120 which are in turn disposed, respectively, in the through bores 122 and 124 in the outer flange 82c of the tread member 16c. The bolt members 118, 120 then extend from the outer flange 82c through the respective slots 108 of the section 14a, represented by the slot 108a in FIG. 8. Thereafter, the stringer section 14b is caused to overlie the section 14a with the slots 107b thereof aligning with slot 108a of the section 14a, so that the bolts 118, 120, in addition, pass through the slots 107b. With this portion of the assembly completed, the nut members 126 and 128 are engaged with the bolt member 118, 120 respectively to complete the engagement of the tread member 16c, the stringer section 14a and the stringer section 14b as set forth in FIG. 7.

Thereafter, the additional stringer sections 14 are installed in a like manner, with adjacent stringer sections overlapping and secured to the respective tread members 16. At appropriate intervals, as hereinbefore described at FIG. 4, the tread braces 36 may be installed to provide support for the stringer assembly 12 and the associated tread members. Also, additional bracing means, known in the art, may be employed. As shown in FIG. 1, the bottom tread member 16d, and the stringer assembly 12, is supported by a stringer section 14c which is reversed, to provide foot clearance for the user, and bolted to a support member 130 at ground level.

There is also provided on the stairway system 10 a handrail assembly 132 which includes a handrail 134, an auxiliary rail 136 and a plurality of ballusters 138, each attached to an associated stringer section 14 in a manner identical with the mounting of the platform bannister 74 on the stringer section 14a as described with respect to FIG. 7. Specifically, each of the ballusters 138 attaches by through bores, not shown, which align with one of the slots 107 and the slot 110 in the stringer section 14. As is shown in the identical construction of the balluster 74 in FIG. 7, each of the ballusters attached to one of the stringer sections 14 may have preformed through bores, not shown, for such attachment, as the vertical distance between the slots 107 and the slot 110 is uniform in each of the stringer sections 14.

As is shown in FIG. 3, each of the tread members 16 is splayed and diverges outwardly from adjacent tread members due to the curvature of wall 35, and extends from the wall substantially along a radius of said curvature. Therefore, when the radius of the wall 35 changes, the angle of this divergence may vary substantially. Accordingly, the slots 107 and 108 in the stringer sections 14 are of a sufficient horizontal dimension to allow for this variation, and each of the stringer sections 14 is adjustable with respect to the adjacent sections to allow for the installation of the stairway system 10 on a wide variety of building sizes. Furthermore, as shown in FIG. 3, the geometric pattern of the tread members 16 is uniform from the top to the bottom so that when the stairway is traveled at a given distance from the wall 35 or the handrail assembly 32, the tread width of each of the members 16 is identical.

In addition, each of the stringer sections 14 is seen to substantially conform, in a respective vertical and horizontal event, to the unit rise and run of the stairway system such that the progression of treads is constant in each direction.

While the present embodiment is shown rising clockwise on a storage structure including walls having a horizontal curvature, it is to be understood that the stairway system 10 may also be advantageously constructed to rise counter-clockwise or installed on a wide variety of buildings including those having flat walls due to the adjustable nature of the system and the adaptability of its component parts. In addition, the stairway system 10 may similarly be installed on the inside of the structure 18 in a manner comparable to that hereinbefore described. Any suitable material may be employed in fabricating the various parts of the present invention, and galvanized steel, most commonly utilized to fabricate the storage structure 18, has been found to be satisfactory. As many tread members and stringer section as are required may be used to attain the desired stairway length.

Accordingly, the stairway system of the present invention may be easily and inexpensively manufactured and installed on a wide variety of building shapes and sizes. The stairway may be prefabricated and includes a minimum number of separate components, each of which is individually small enough to facilitate transportation to the installation site. The system can be easily detached from an existing structure and applied to a second building, as the stringer assembly is easily adjusted to compensate for different wall curvatures and the length of the stairway system may be easily adjusted by the simple addition of tread members and stringer sections.

Also, the bracket and brace members have dimensions and corresponding through bores which match the regular bolt spacings on common storage structures.

The drawings and foregoing descriptions are not intended to represent the only form of the invention in regard to the details of its construction and manner of use. Changes in form and in the proportion of parts, as well as substitution of equivalents, are contemplated as the circumstances may suggest or render expedient; and although specific terms have been employed, they are intended in a generic and descriptive sense only and not for purposes of limitation, the scope of the invention being delineated in the following claims.

The following is claimed as invention:

1. A stairway system for a wall having a horizontal curvature, the wall being comprised of adjacent overlying wall sections forming overlapping seams therebetween, said system comprising:

a first plurality of adjacent stringer sections adjustably joined to form a single stringer assembly spaced from and conforming substantially to the curvature of said wall;

a second plurality of tread members disposed between the wall and said stringer assembly, each of said members extending from the wall substantially along a radius of said curvature; and attachment means to secure said tread members to the wall, the attachment means including an array of brackets, each of said brackets being secured to at least one of said tread members and attached to the wall by fastener means disposed in at least one of said overlapping means.

2. A stairway system according to claim 1 wherein each of said stringer sections comprises a metal plate having at least one slot which aligns with an opening in an adjacent stringer section.

3. A stairway system according to claim 1 wherein each of said stringer sections has a vertical extent corresponding substantially to the unit rise of said tread members and a horizontal extent corresponding substantially to the unit run of said tread members.

4. A stairway system according to claim 3 which further includes a platform structure comprising a plurality of adjacent platform stringer sections adjustably joined to form a platform stringer assembly spaced from and conforming substantially to the curvature of said wall, and an array of platform members disposed between said wall and said platform stringer assembly, each of said members extending from said wall substantially along a radius of said curvature.

5. A stairway system according to claim 3 which further includes a series of ballusters secured to the stairway stringer assembly and a series of adjacent rail sections adjustably joined and secured to said ballusters to form a handrail.

6. A stairway system for a building which includes adjacent overlying sections joined to form a wall and a plurality of overlapping seams in said wall, said stairway system comprising:

a single stringer assembly spaced from said wall;

an array of tread members disposed between the stringer assembly and the wall; and a plurality of vertical bracket means to attach the tread members to the wall, each of said bracket means being secured to at least one of said tread members and attached to the wall by fastener means disposed in said overlapping seams.

7. A stairway system according to claim 6 wherein the stringer assembly comprises a plurality of adjacent stringer sections, each of said stringer sections having a vertical extent corresponding substantially to the unit rise of said tread members and a horizontal extent corresponding substantially to the unit run of said tread members.

8. A stairway system according to claim 7 which further includes a series of ballusters secured to the stringer assembly and a handrail secured to the ballusters.

9. A storage structure comprising adjacent overlying wall sections joined to form a wall and a plurality of overlapping seams therein; an array of tread members disposed on said wall; vertical bracket means attaching a first end of each of the tread members to the wall, each of said brcket means being secured to at least one of the tread members and attached to the wall by fastener means disposed in said overlapping seams; and a plurality of adjacent stringer sections joined to form a single stringer assembly supporting a second end of each of the tread members, each of said stringer sections having a vertical extent corresponding subsantially to the unit rise of said tread members and a horizontal extent corresponding substantially to the unit run of said tread members.

10. A stairway system for selective installation on non-linear walls having various horizontal curvatures and corresponding radii of curvature and substantially adjustable to accommodate said various radii, the system comprising:

an array of tread members adapted to be secured at a first end to said walls to form a stairway, each of said tred members disposed to conform substantially to the radii of said walls;

bracket means adapted to secure each of the tread members to said walls, the bracket means including a plurality of bracket sets, each set including three brackets, and each bracket in the set of three being mounted on the wall at a height substantially equal to the height at which the other two brackets in the set are mounted on the wall, the system further including a plurality of stringer sections, each of the stringer sections having a vertical extent corresponding substantially to the unit rise of the tread members and a horizontal extent corresponding substantially to the unit run of the tread members, each of the stringer sections further having at least one slot adapted to align with an opening in an adjacent stringer section to adjustably join the stringer sections to form a single stringer assembly conforming substantially to the curvature of said walls and supporting a second end of said tread members.

* * * * *

UNITED STATES PATENT AND TRADEMARK OFFICE

CERTIFICATE OF CORRECTION

PATENT NO. : 4,419,851

DATED : December 13, 1983

INVENTOR(S) : Joseph A. Kruger

It is certified that error appears in the above-identified patent and that said Letters Patent is hereby corrected as shown below:

Column 3, line 49, change "42" to --52--;

Column 6, line 52, change "event" to --extent--;

Column 7, line 47, change "means" to --seams--.

Signed and Sealed this

Twenty-ninth Day of May 1984

[SEAL]

*Attest:*

GERALD J. MOSSINGHOFF

*Attesting Officer*

*Commissioner of Patents and Trademarks*